US006559627B2

(12) United States Patent
Khouri et al.

(10) Patent No.: US 6,559,627 B2
(45) Date of Patent: May 6, 2003

(54) VOLTAGE REGULATOR FOR LOW-CONSUMPTION CIRCUITS

(75) Inventors: Osama Khouri, Milan (IT); Ilaria Motta, Cassolnovo (IT); Rino Micheloni, Turate (IT); Guido Torelli, Sant' Alessio con Vialone (IT)

(73) Assignee: STMicroelectronics S.r.l., Agrate Brianza (IT)

( * ) Notice: Subject to any disclaimer, the term of this patent is extended or adjusted under 35 U.S.C. 154(b) by 0 days.

(21) Appl. No.: 10/008,540

(22) Filed: Nov. 7, 2001

(65) Prior Publication Data

US 2002/0089317 A1 Jul. 11, 2002

(51) Int. Cl.[7] ..... G05F 1/56
(52) U.S. Cl. ..... 323/282
(58) Field of Search ..... 323/273, 280, 323/282, 312, 351; 327/536

(56) References Cited

U.S. PATENT DOCUMENTS 5,589,762 A * 12/1996 Iannuzo ..... 323/351
5,793,679 A * 8/1998 Caser et al. ..... 365/185.27
5,914,589 A * 6/1999 Erckert ..... 323/282
6,157,054 A * 12/2000 Caser et al. ..... 257/299
6,184,670 B1 * 2/2001 Mulatti et al. ..... 323/314
6,222,355 B1 * 4/2001 Ohshima et al. ..... 323/282
6,366,154 B2 * 4/2002 Pulvirenti ..... 327/525
6,437,636 B2 * 8/2002 Zammattio et al. ..... 327/536
6,438,005 B1 * 8/2002 Walter ..... 363/60
6,469,482 B1 * 10/2002 Jahanshir et al. ..... 323/282

* cited by examiner

*Primary Examiner*—Adolf Deneke Berhane
(74) *Attorney, Agent, or Firm*—Lisa K. Jorgenson; E. Russell Tarleton; Seed IP Law Group PLLC

(57) ABSTRACT

A voltage regulator having a comparator with an output terminal that is the output of the regulator, terminals for connection to a voltage supply, a source of a reference voltage connected to an input terminal of the comparator, and a feedback circuit connected between the output terminal and the other input terminal of the comparator. To prevent transients upon the transition from the standby state to the active state, there is provided a second reference-voltage source that provides a reference voltage substantially equal to that of the first source, a switch for connecting the second source to the other input terminal of the comparator, and a control circuit that can activate the supply of the regulator and can close the switch for a predetermined period of time when the supply of the regulator is activated.

12 Claims, 5 Drawing Sheets

VOLTAGE REGULATOR FOR LOW-CONSUMPTION CIRCUITS

BACKGROUND OF THE INVENTION

1. Field of the Invention

Figure 1:
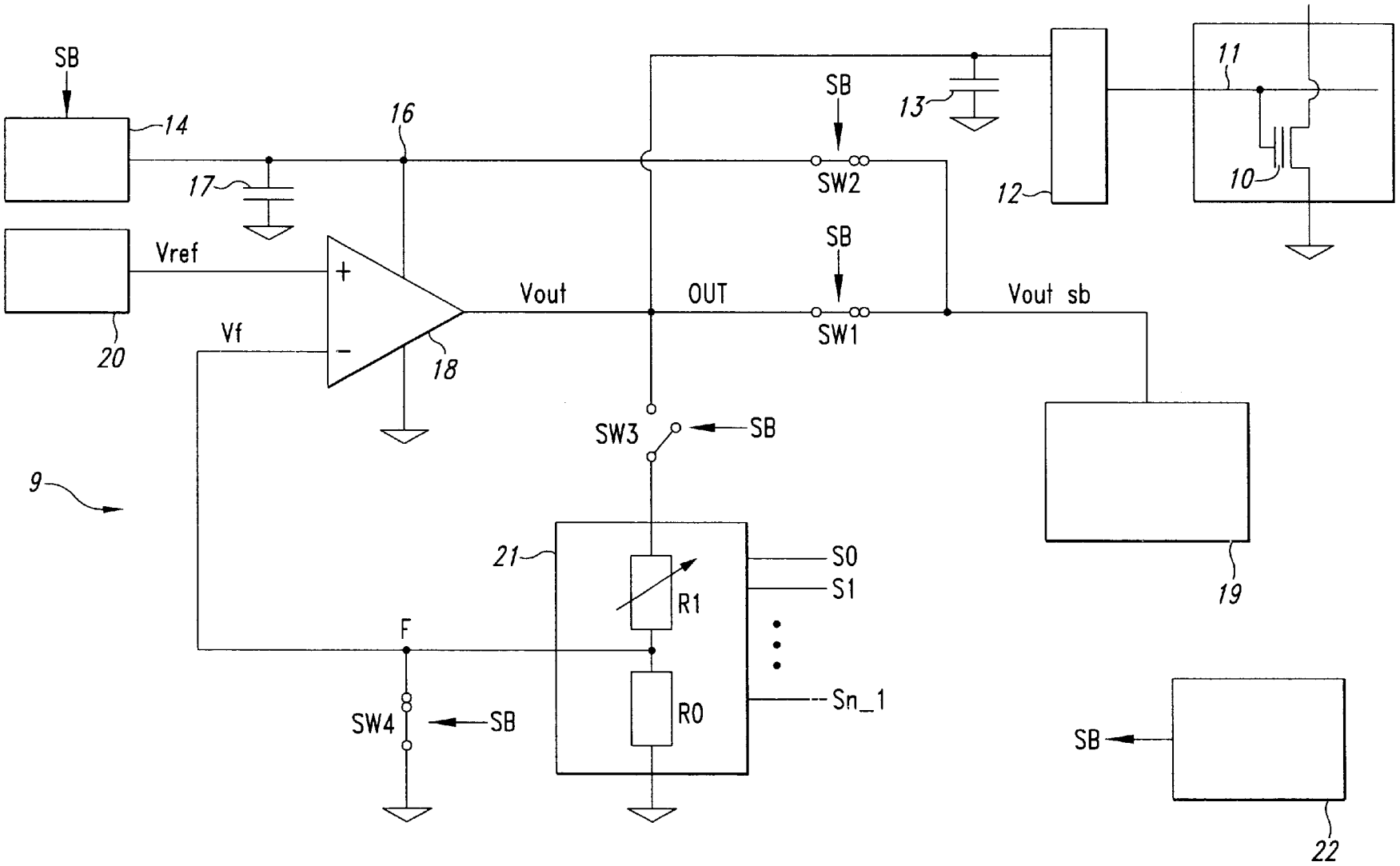

The present invention relates to voltage regulators and, more particularly, to a voltage regulator for use in a low-consumption circuit system.

2. Description of the Related Art

In a circuit system constituted by various devices which perform different functions in a coordinated manner, it is known, in order to reduce energy consumption, to supply energy only to the devices which are necessary to the system at the time in question in preselected operating conditions, whilst the devices which are not necessary are kept in a waiting or standby state in which energy consumption is very low. In many cases, it is important for the transition from the standby state to the active state to be quick and free of transients.

A circuit system of this type is that which controls the operation of a non-volatile memory. To illustrate the invention, reference will be made below to such an application and, in particular, to a multilevel non-volatile memory.

In a multilevel memory, each cell can adopt several threshold-voltage levels so that it is possible to store several bits in each individual cell. A cell which can store n bits will therefore be characterized by $2^n$ possible threshold-voltage distributions.

Clearly, as the number of threshold-voltage levels increases, the precision requirements in order for the operations of the cell, in particular, the programming and reading operations, to be performed correctly, also increase. As is known, programming takes place by applying a voltage which is variable in steps to the row (or word line) containing the cell to be programmed, that is, to the gate terminals of all of the cells of a row, and by applying a relatively high voltage to the column line, that is, to the drain terminal of the cell. According to a conventional procedure, reading takes place by applying a fixed voltage to the row line of the cell to be read and measuring the current which flows through the column line of the cell. The value of the current measured indicates the logic state of the cell.

It is difficult to achieve the necessary precision in multilevel memories with a low supply voltage (3V or less). In these cases, the high voltages which are necessary for the reading, programming and erasure operations are generated by voltage-boosters based on the charge-pump principle. As is known, a charge pump is a generator with characteristics quite different from those of an ideal voltage generator; in fact, it has a fairly high output resistance so that the output voltage is greatly dependent on the load. Moreover, after overloading, it requires quite a long time to return to the nominal output voltage. Moreover, since the nominal output voltage cannot be set precisely, it is necessary to associate with the charge pump a regulation circuit that contributes to energy consumption.

To reduce consumption, the voltage-boosters are normally deactivated when the device to which they belong is in the standby state. In ideal conditions, the voltages present at the output nodes of the voltage-boosters would remain constant indefinitely but, in practice, they decrease within fairly short periods of time, due to current leakage at the junctions of the transistors connected to the output nodes. When a transition takes place from the standby state to the active state, it is therefore not possible to reach the necessary biasing voltage quickly and with the desired accuracy.

FIG. 1 shows schematically a known circuit system for biasing a row line of a non-volatile memory which uses a voltage-booster. A non-volatile memory, for example, a four-level flash memory supplied at 3V, is formed by a plurality of memory cells 10 arranged in rows and columns. In particular, the cells 10 belonging to the same row have their respective gate electrodes connected to a common row line 11. A row decoder 12 selectively connects one of the row lines 11 to the output terminal OUT of a voltage-booster 9. A capacitor 13 connected between the output terminal OUT and the earth terminal of the circuit system represents the stray capacitance of the decoder circuits 12 and, when a row line is connected, the stray capacitance of the line.

The voltage-booster 9 comprises a charge pump 14 with an output capacitor 17 and a voltage regulator. The charge pump 14 is connected to a node 16 to which a supply terminal of the regulator is connected. The regulator comprises a comparator 18, a reference-voltage source 20, and a feedback circuit. The comparator 18 is preferably constituted by a differential input stage, by a power output stage, and by a frequency-compensation circuit (not shown). The output of the comparator 18 is also the output OUT of the regulator and is connected, by means of a switch SW1, to a standby-voltage generator 19. The node 16 is also connected to the standby-voltage generator 19 by means of a switch SW2.

The comparator 18 has a first, non-inverting input terminal (+) connected to the reference-voltage source 20 and a second, inverting input terminal (−) which is connected to the output terminal OUT by means of the feedback circuit. The feedback circuit comprises a resistive divider 21 which is connected, on one side, to the output OUT by means of a switch SW3 and, on the other side, to a common reference terminal of the circuit, in this example, to the earth, and which has an intermediate tap connected to the inverting input of the comparator 18 at a node F and to earth by means of a switch SW4.

The reference-voltage source 20, which is preferably a "bandgap" circuit, is never deactivated unless the supply is removed from the device as a whole, because its turn-on and reference-voltage regulation time is quite long (10$\mu$s). However, it can be formed so as to dissipate a fairly low current (10$\mu$A).

A control circuit 22, which preferably forms part of the logic control unit of the memory, generates a standby signal SB which activates or deactivates the charge pump 14 and opens or closes the switches SW1–SW4. In FIG. 1, the switches are shown in the positions corresponding to a high-level signal SB, that is, when the circuit is in standby condition.

The divider 21 comprises a fixed resistive element R0 and a resistive element R1 which is variable in dependence on the state of an n-bit digital signal S0–Sn−1. Variation of the division ratio of the divider 21 causes the feedback coefficient of the regulator also to vary. It can easily be shown that the voltage Vout at the output terminal OUT is $$Vout = Vref(1 + R1/R0),$$

where Vref is the voltage of the reference-voltage source 20; the regulator thus forms a D/A (digital/analog) converter the output voltage Vout of which is the analog quantity corresponding to a combination of states of the inputs S0–Sn−1, that is, to a binary input number.

In controlling the standby state, it is necessary to address two problems, that is: to find a way to reduce overall consumption by deactivating some circuits without turning them off completely so that they can be turned on again quickly, and to prevent spurious transients upon leaving the standby state.

In a circuit of the type shown in FIG. 1, the first problem can be solved if, in a standby state, the output OUT and the voltage at the node 16 are kept at a voltage value equal to or slightly greater than the operating voltage. For this purpose, a low-consumption generator 19 with an output voltage Voutsb is connected to the output OUT and to the node 16 in the standby state (SW1 and SW2 closed). A generator usable in the circuit of FIG. 1 is described, for example, in the Applicant's European patent application entitled "A voltage-raising device for non-volatile memories operating in a low-consumption standby condition".

The second problem can be solved only by avoiding any capacitive component in the feedback circuit of the regulator, as will be understood from the following.

Figure 2:
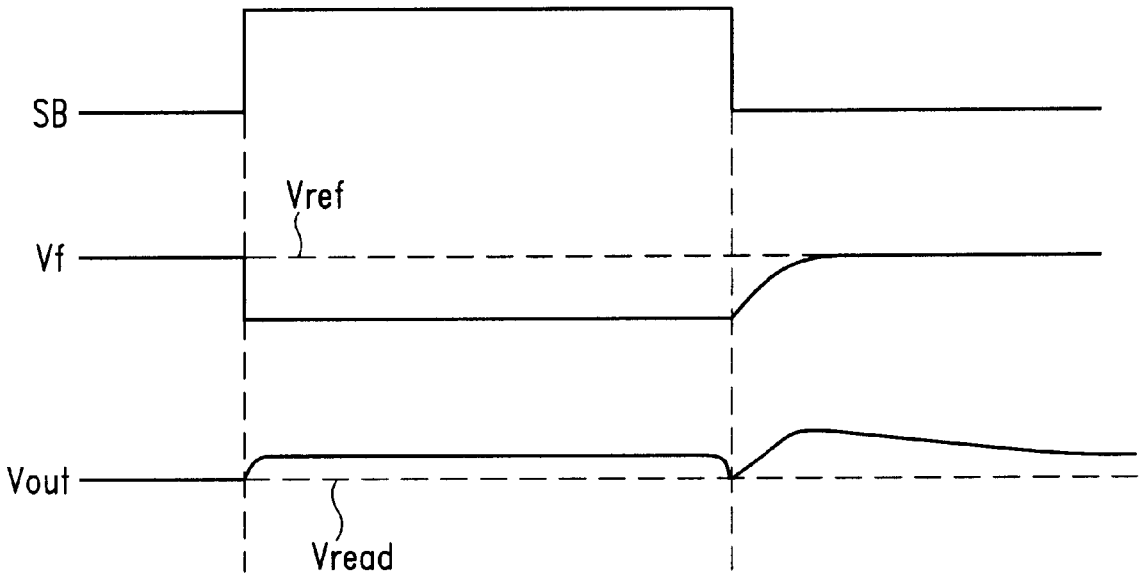

With reference to FIGS. 1 and 2, in standby (signal SB high), the charge pump 14 is deactivated, the output OUT and the node 16 are connected to the output of the low-consumption generator 19 by the switches SW1 and SW2, the feedback circuit is deactivated since the switch SW3 is open, and the inverting input terminal (−) of the comparator 18 is connected to earth by means of the switch SW4; the consumption of the feedback circuit in standby is thus zero. When it is necessary to change from the standby state to the active state (SB low in FIG. 2), the voltage at the terminal OUT is almost at the correct value (for example, if the regulator has to supply a reading voltage Vread=6V, Vout=Voutsb may be 6.2V) and the regulator should not therefore have to supply current to the load. However, this is true only if the feedback voltage Vf, that is, the voltage of the inverting terminal (−) of the comparator 18, is equal to the voltage (Vref) of the non-inverting terminal (+). Since the inverting terminal (−) is earthed in the standby state, the time taken to return to the voltage Vref depends on the stray capacitances of the feedback circuit. During the charging of these capacitances, the voltage at the inverting terminal (−) of the comparator 18 increases from 0 to Vref and the regulator supplies current to the load so that there is an undesired transient, possibly of considerable amplitude, for example, 0.6–0.7V, at the terminal OUT, as can be seen in FIG. 2.

To prevent or to reduce this effect as far as possible it is necessary to design the feedback circuit in a manner such that the capacitances associated therewith are as low as possible. To satisfy this requirement, it is not possible to form the divider 21 with resistive elements formed by diffused "well" regions and by MOS field-effect transistors, as would be appropriate and advantageous, particularly if a precise and variable division ration controlled by a digital signal is to be obtained.

SUMMARY OF THE INVENTION

The disclosed embodiment of the present invention provides a regulator of the type described above which, whilst having a feedback circuit with significant capacitive components, does not have transient effects upon a transition from the standby state to the active state.

In accordance with one embodiment of the invention, a voltage regulator is provided that includes a comparator having a first input terminal, a second input terminal, and an output terminal; a first reference voltage source that provides a reference voltage to the first input terminal of the comparator; a feedback circuit connected between the output terminal and the second input terminal of the comparator; a second reference-voltage source that provides a reference voltage substantially equal to the reference voltage of the first reference-voltage source; a controllable switch to connect the second reference-voltage source to the second input terminal of the comparator; and a control circuit for activating the supply of the regulator and for closing the controllable switch for a predetermined period of time when the supply of the regulator is activated.

BRIEF DESCRIPTION OF THE SEVERAL VIEWS OF THE DRAWING(S)

Figure 3:
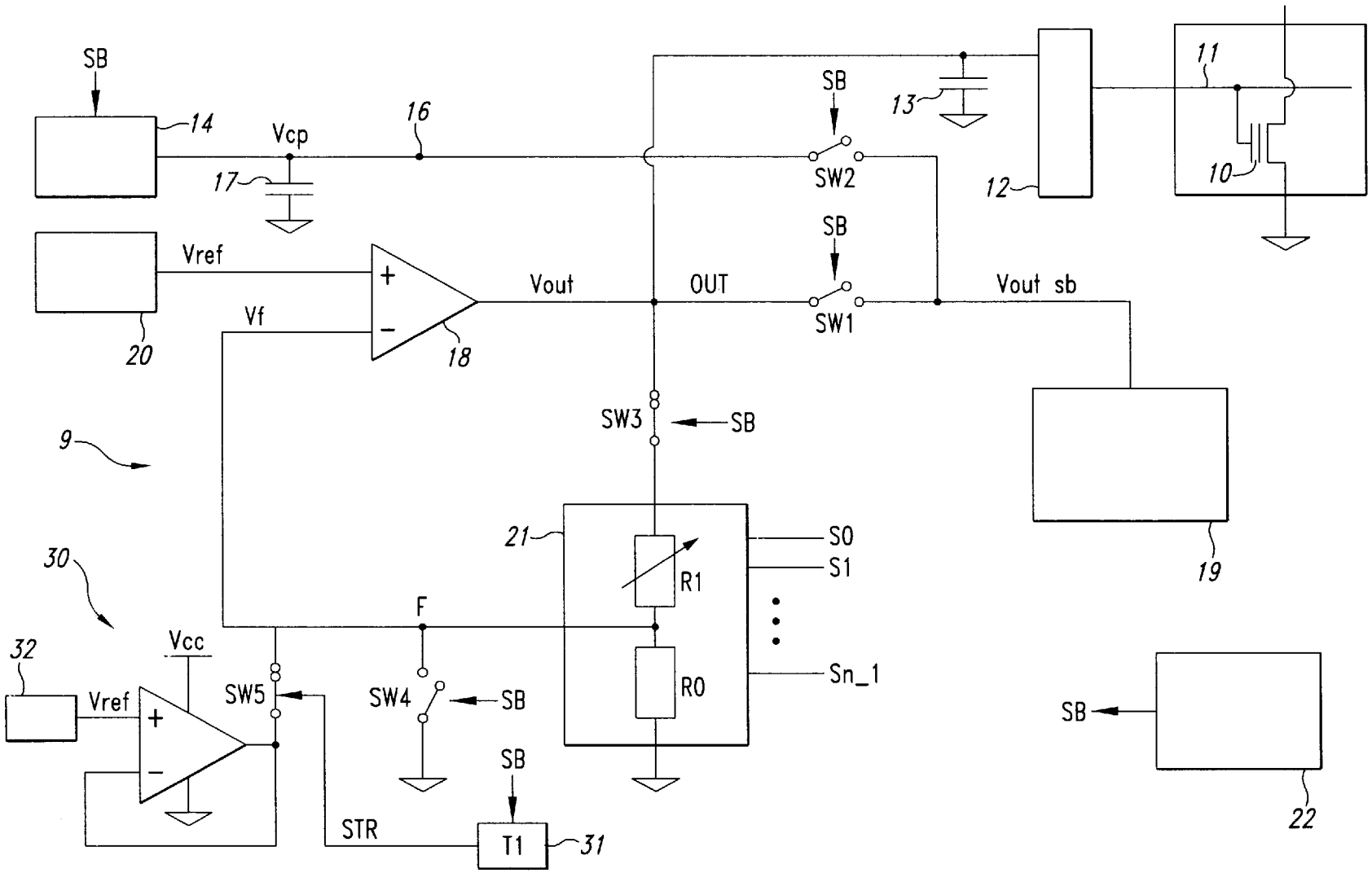
Figure 4:
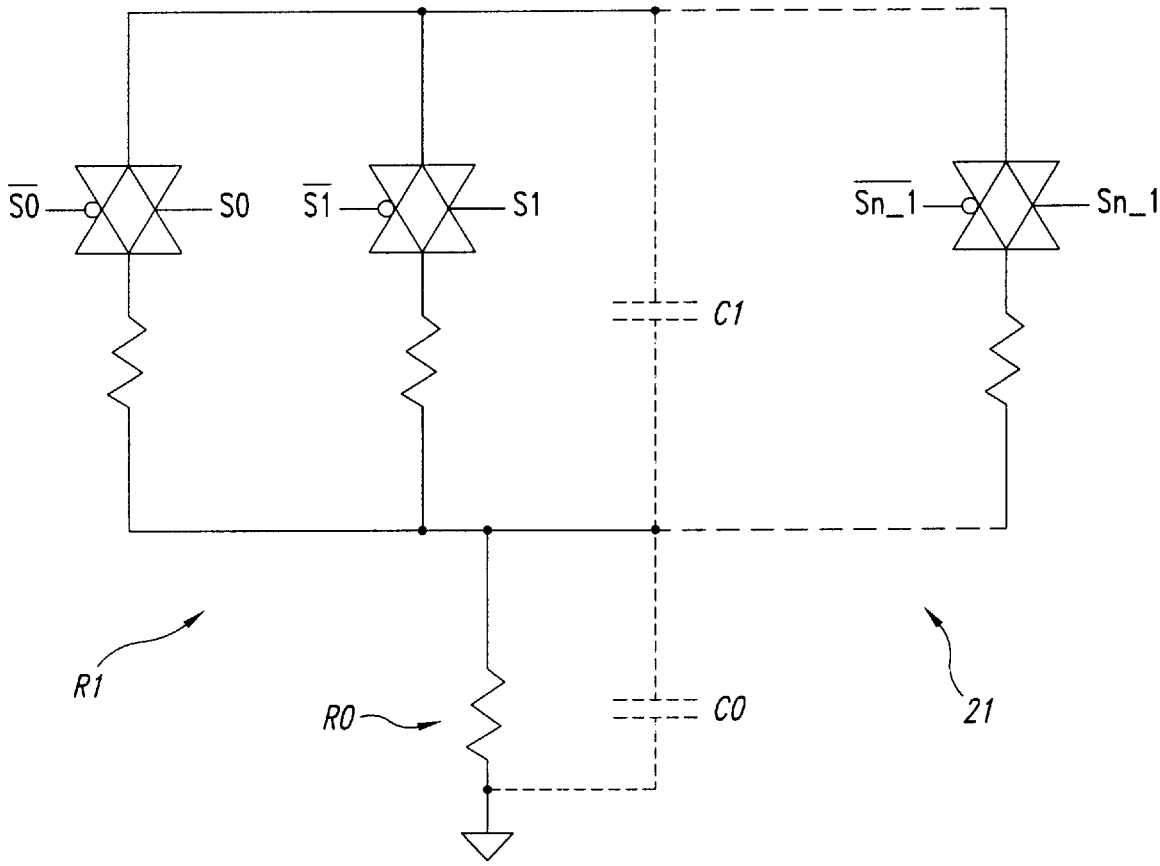
Figure 5:
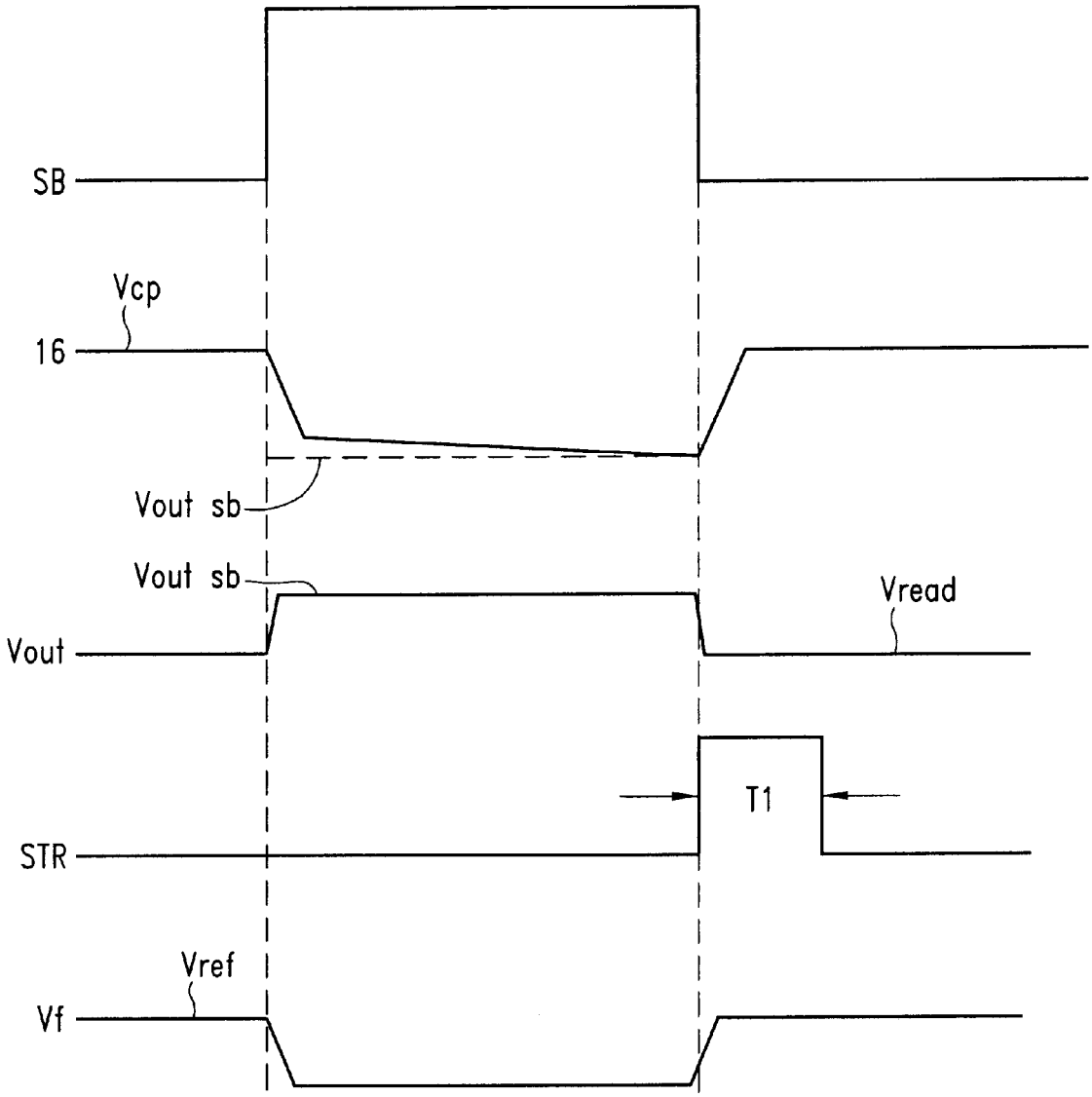

The invention will be understood further from the following detailed description of an embodiment thereof, provided by way of non-limiting example with reference to the appended drawings, in which:

FIG. 1 is a block diagram of a known row-line biasing circuit of a non-volatile memory, FIG. 2 shows how the voltage at two nodes of the circuit of FIG. 1 varies over time in the standby state and in the active state, FIG. 3 is a block diagram of a row-line biasing circuit according to the invention, FIG. 4 is a circuit diagram of a divider usable in the circuit of FIG. 3, and FIG. 5 shows how the voltages at some nodes of the circuit of FIG. 3 vary over time.

DETAILED DESCRIPTION OF THE INVENTION

The block diagram of FIG. 3 shows a circuit similar to that shown in FIG. 1 but which uses a regulator according to the invention. The elements of FIG. 3 that are identical or correspond to those of FIG. 1 are indicated by the same reference numerals or symbols. In the circuit of FIG. 3, the switches controlled by the signal SB are shown in the positions corresponding to the active state of the circuit, immediately following a standby state. The charge pump 14 is activated and supplies a voltage Vcp only when the signal SB is at low level, that is, when the circuit is in the active state.

The regulator according to the invention comprises a starter circuit formed by a voltage generator 30, by a timer 31, and by a switch SW5 controlled by the output of the timer 31, which in turn is controlled by the signal SB. The switch SW5 enables the connection of the voltage generator 30 to the node F, that is, to the inverting terminal (−) of the comparator 18, to be activated or deactivated. The voltage generator 30, which is shown as an operational amplifier with its inverting input connected to its output and with its non-inverting input connected to a reference-voltage source 32, is supplied by the supply voltage Vcc of the integrated circuit of which the circuit of FIG. 3 forms part. The voltage of the source 32 is selected so as to be substantially equal to the voltage Vref of the reference-voltage source 20. The closure of the switch SW5 is brought about by a start signal STR of predetermined duration T1, generated by the timer 31.

The divider 21 is preferably formed by resistive elements constituted by diffused "well" regions and by complementary MOS field-effect transistors connected as controllable gates (pass gates), all of the components having appreciable stray capacitances. An example of a divider of this type is shown in FIG. 4. The variable resistive element R1 is constituted by a network formed by n branches in parallel. Each of the n branches is formed by a resistor in series with a controllable gate. The division ratio of the divider 21 can be set to $2^n$ different values by the selection of the states of the n gates by means of suitable binary control signals S0–Sn–1. The stray capacitances are represented by two capacitors C0 and C1 in parallel with the resistor R0 and with the n branches which form the variable resistor R1, respectively.

The operation of the regulator according to the invention in the situation in which a transition takes place from a standby state to an active state for an operation to read the memory will now be considered with reference to FIG. 5. As is known, the reading operation is the most critical operation when a memory is put back in operation after a standby, since the time required for reading is much shorter than that required for the other operations.

In the standby state (SB high) the output OUT and the node 16 are at the voltage Voutsb, which is generated by the low-consumption generator 19, and which has a value between the output voltage Vcp of the charge pump 14 and the reading voltage Vread for biasing the row line of the memory. The inverting terminal (–) of the comparator 18 is at the earth potential, since the switch SW4 is closed and the switch SW5 is open. At the moment at which the signal SB changes to the low level, the charge pump 14 is activated, the timer 31 is started, the switches SW1, SW2 and SW4 are opened, and the switches SW3 and SW5 are closed. In this situation, the generator 30, which is supplied with the voltage Vcc, applies the voltage Vref to the node F, thus charging the capacitances present in the feedback circuit, in particular, the stray capacitances C0 and C1 of the resistors and of the transistors of the resistive divider 21.

Since the input terminals of the comparator 18 are at the same voltage Vref, there is no appreciable transient voltage at the output OUT. The duration T1 determined by the timer 31 for the start signal STR is selected so as to be no longer than the time which is considered necessary for correct adjustment of the internal nodes of the divider. In a practical embodiment, this duration was about 20 ns. With the regulator according to the invention, the transition from the standby state to the active state thus takes place quickly and without stray transients in the row line, in spite of the presence of stray capacitances in the feedback circuit.

Although the regulator according to this embodiment of the invention has been described with reference to the reading operation, naturally, it is also used with the same advantages for regulating the voltage of the row lines during the programming of the memory. In this case, charge pumps having suitable output voltages are used and suitable division ratios are selected by means of the digital signal S0–Sn–1.

From the foregoing it will be appreciated that, although specific embodiments of the invention have been described herein for purposes of illustration, various modifications may be made without deviating from the spirit and scope of the invention. Accordingly, the invention is not limited except as by the appended claims and the equivalents thereof.

What is claimed is:

1. A voltage regulator comprising:

a comparator having a first input terminal and a second input terminal, an output terminal that is the output of the regulator, and terminals for connection to a voltage supply;

a first reference-voltage source that provides a reference voltage, and is connected to the first input terminal of the comparator;

a feedback circuit connected between the output terminal and the second input terminal of the comparator;

a second reference-voltage source that provides a reference voltage substantially equal to the reference voltage of the first reference-voltage source, controllable switch means for connecting the second reference-voltage source to the second input terminal of the comparator; and control means for activating the supply of the regulator and for closing the switch means for a predetermined period of time when the supply of the regulator is activated.

2. The regulator of claim 1 in which the feedback circuit comprises a voltage divider connected between the output terminal of the comparator and a reference terminal and having an intermediate tap connected to the second terminal of the comparator.

3. The regulator of claim 2 in which the feedback circuit comprises switch means that can be controlled by the control means in order to deactivate the feedback.

4. The regulator of claim 2, in which the divider comprises a plurality of resistive elements with associated controllable switches for modifying the division ratio of the divider by the selection of different resistive elements.

5. A voltage regulator, comprising:

a comparator having first and second input terminals and an output terminal;

a first reference voltage source coupled to the first input terminal of the comparator;

a feedback circuit coupled between the output terminal and the second input terminal of the comparator and comprising a voltage divider;

a second reference voltage source providing a reference voltage substantially equal to a reference voltage of the first reference voltage source and coupled to the second input of the comparator via a controllable switch; and a control circuit coupled to the controllable switch, the control circuit activating a voltage supply to the regulator and closing the controllable switch for a predetermined time when the voltage supply of the regulator is activated.

6. The regulator of claim 5, wherein the control circuit comprises a timer circuit coupled to the controllable switch.

7. A voltage regulator circuit, comprising:

a first voltage supply source for supplying voltage to the regulator circuit upon receipt of an activation signal;

a comparator having first and second input terminals and an output terminal;

a first reference voltage source coupled to the first input terminal of the comparator;

a feedback circuit coupled between the output terminal and the second input terminal of the comparator and comprising a voltage divider;

a second reference voltage source providing a reference voltage substantially equal to a reference voltage of the first reference voltage source and coupled to the second input of the comparator via a controllable switch; and a control circuit coupled to the controllable switch, the control circuit generating the activation signal and closing the controllable switch for a predetermined time when the voltage supply of the regulator circuit is activated.

8. A voltage regulator circuit, comprising:

a first voltage supply source for supplying voltage to the regulator circuit upon receipt of an activation signal;

a comparator having first and second input terminals and an output terminal;

a first reference voltage source coupled to the first input terminal of the comparator;

a feedback circuit coupled between the output terminal and the second input terminal of the comparator and comprising a voltage divider;

a second reference voltage source providing a reference voltage substantially equal to a reference voltage of the first reference voltage source and coupled to the second input of the comparator via a controllable switch; and a control circuit coupled to the controllable switch, the control circuit generating the activation signal, the control circuit further comprising a timer circuit for closing the controllable switch for a predetermined time upon generation of the activation signal.

9. The voltage regulator circuit of claim 8, wherein the voltage divider comprises a plurality of resistive elements having associated controllable switches for modifying the division ratio of a divider by the selection of different resistive elements.

10. A digital/analog converted, comprising:

a voltage regulator circuit, comprising:

a first voltage supply source for supplying voltage to the regulator circuit upon receipt of an activation signal;

a comparator having first and second input terminals and an output terminal;

a first reference voltage source coupled to the first input terminal of the comparator;

a feedback circuit coupled between the output terminal and the second input terminal of the comparator and comprising a voltage divider;

a second reference voltage source providing a reference voltage substantially equal to a reference voltage of the first reference voltage source and coupled to the second input of the comparator via a controllable switch;

a control circuit coupled to the controllable switch, the control circuit activating generating the activation signal, the control circuit further comprising a timer circuit for closing the controllable switch for a predetermined time upon generation of the activation signal; and the voltage divider comprising a plurality of resistive elements having associated controllable switches for modifying the division ratio of the divider by the selection of different resistive elements, the states of the controllable switches configured to identify an input datum to be converted, and the voltage at the output terminal of the comparator configured to represent the analog output quantity of the converter.

11. A row-voltage generator for a non-volatile memory, comprising:

a line decoder configured to be coupled to the non-volatile memory, the line decoder having an input terminal; and a voltage regulator circuit, comprising:

a first voltage supply source for supplying voltage to the regulator circuit upon receipt of an activation signal;

a comparator having first and second input terminals and an output terminal, the output terminal coupled to the input terminal of the line decoder;

a first reference voltage source coupled to the first input terminal of the comparator;

a feedback circuit coupled between the output terminal and the second input terminal of the comparator and comprising a voltage divider;

a second reference voltage source providing a reference voltage substantially equal to a reference voltage of the first reference voltage source and coupled to the second input of the comparator via a controllable switch; and a control circuit coupled to the controllable switch, the control circuit generating the activation signal and further comprising a timer circuit for closing the controllable switch for a predetermined time when the first voltage supply source is activated.

12. The row-voltage generator of claim 11, comprising a voltage generator and a switch circuit coupled to the control circuit for connecting the voltage generator to the output terminal of the comparator when the voltage supply of the regulator is de-activated.

* * * * *

UNITED STATES PATENT AND TRADEMARK OFFICE

CERTIFICATE OF CORRECTION

PATENT NO. : 6,559,627 B2
DATED : May 6, 2003
INVENTOR(S) : Osama Khouri et al.

It is certified that error appears in the above-identified patent and that said Letters Patent is hereby corrected as shown below:

Title page,
Item [30], Foreign Application Priority Data, should read as:

-- November 8, 2000 (IT) …….RM2000A000577 --

Signed and Sealed this

Thirtieth Day of September, 2003

JAMES E. ROGAN
*Director of the United States Patent and Trademark Office*